US011047082B2

(12) United States Patent
Jeoung et al.

(10) Patent No.: US 11,047,082 B2
(45) Date of Patent: Jun. 29, 2021

(54) WASHING MACHINE

(71) Applicant: Samsung Electronics Co., Ltd., Suwon-si (KR)

(72) Inventors: Jeoung Kyo Jeoung, Yongin-si (KR); Doo Young Rou, Suwon-si (KR); Yong Jong Park, Seongnam-si (KR); Hee Tae Lim, Yongin-si (KR); Gyu Dong Jeon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 210 days.

(21) Appl. No.: 15/781,860

(22) PCT Filed: Jul. 7, 2017

(86) PCT No.: PCT/KR2017/007288

§ 371 (c)(1),
(2) Date: Jun. 6, 2018

(87) PCT Pub. No.: WO2018/034432

PCT Pub. Date: Feb. 22, 2018

(65) Prior Publication Data

US 2018/0355540 A1 Dec. 13, 2018

(30) Foreign Application Priority Data

Aug. 18, 2016 (KR) ..... 10-2016-0104854

(51) Int. Cl.

| | |
|---|---|
| ***D06F 37/30*** | (2020.01) |
| ***D06F 37/04*** | (2006.01) |
| ***D06F 37/40*** | (2006.01) |

(52) U.S. Cl.
CPC ..... *D06F 37/304* (2013.01); *D06F 37/04* (2013.01); *D06F 37/40* (2013.01)

(58) Field of Classification Search
CPC ..... D06F 37/304
See application file for complete search history.

(56) References Cited

U.S. PATENT DOCUMENTS

| | | | |
|---|---|---|---|
| 10,513,816 | B2 | 12/2019 | Nakamoto |
| 2004/0163429 | A1 | 8/2004 | Lim |

FOREIGN PATENT DOCUMENTS

| | | | |
|---|---|---|---|
| CN | 1282785 | C | 11/2006 |
| CN | 103346655 | A | 10/2013 |
| CN | 103668855 | A | 3/2014 |
| CN | 105088621 | A | 11/2015 |
| CN | 106661796 | A | 5/2017 |
| JP | H10-225591 | A | 8/1998 |

(Continued)

OTHER PUBLICATIONS

ISA/KR, "International Search Report and Written Opinion," International Application No. PCT/KR2017/007288, dated Sep. 22, 2017, 13 pages.

(Continued)

*Primary Examiner* — Jason Y Ko

(57) ABSTRACT

Disclosed herein is a washing machine. The washing machine includes a main body having a laundry inlet on the front portion, a tub provided inside the main body to store water, a drum rotatably installed inside the tub, a pulsator provided inside the drum and configured to be rotatable with respect to the drum, a first driving motor to provide power to the pulsator, and a second driving motor to provide power to the drum.

20 Claims, 12 Drawing Sheets

(56) References Cited

FOREIGN PATENT DOCUMENTS

| | | | |
|---|---|---|---|
| JP | 2016036398 | A | 3/2016 |
| KR | 10-1999-0079900 | A | 11/1999 |
| KR | 10-2001-0003902 | A | 1/2001 |
| KR | 10-2001-0079463 | A | 8/2001 |
| KR | 10-2005-0087342 | A | 8/2005 |
| WO | 2009062920 | A1 | 5/2009 |
| WO | 2015/127823 | A1 | 9/2015 |
| WO | 2016/019877 | A1 | 2/2016 |

OTHER PUBLICATIONS

Extended European Search Report regarding Application No. 17812297.4, dated Jun. 18, 2018, 7 pages.

Search Report and Written Opinion in connection with Iranian Application No. 139750140003001902, 5 pages.

Office Action dated Sep. 17, 2020 in connection with Chinese Patent Application No. 201780004757.X, 20 pages.

European Search Report dated Jan. 29, 2021 in connection with European Application No. 20203719.8, 7 pages.

WASHING MACHINE

CROSS-REFERENCE TO RELATED APPLICATIONS AND CLAIM OF PRIORITY

The present application claims priority under 35 U.S.C. § 365 and is a 371 National Stage of International Application No. PCT/KR2017/007288, filed Jul. 7, 2017, which claims the benefit of Korean Patent Application No. 10-2016-0104854, filed Aug. 18, 2016, the disclosures of which are fully incorporated herein by reference into the present disclosure as if fully set forth herein.

TECHNICAL FIELD

Embodiments of the present disclosure relate to a washing machine, and more particularly, to a washing machine capable of driving a drum and a pulsator separately.

BACKGROUND

A washing machine is a machine for washing clothes using electric power, and generally includes a tub to store washing water and a drum rotatably installed inside the tub. The washing machine includes a drum type washing machine for washing laundry by raising and lowering the laundry while the rotating tub is rotating, and an electric washing machine to wash the laundry by using water flows generated by the pulsator when the rotating tub is rotated.

In the drum type washing machine, the rotating shaft of the drum is arranged in a substantially horizontal direction, so that the laundry is lifted up and dropped down in accordance with the rotation of the drum, thereby washing the laundry.

Meanwhile, the conventional drum type washing machine includes a lifter provided inside the drum for lifting the laundry upward. On the other hand, the conventional drum type washing machine is not provided with a pulsator to generating water flows inside the drum, unlike the electric washing machine.

SUMMARY

One aspect of the present disclosure discloses a washing machine having a pulsator but no lifter in a drum type washing machine.

Another aspect of the present disclosure discloses a washing machine capable of driving a drum and a pulsator separately in a drum type washing machine.

In accordance with one aspect of the present disclosure, a washing machine includes a main body having a laundry inlet on the front portion, a tub provided inside the main body to store water, a drum rotatably installed inside the tub, a pulsator provided inside the drum and configured to be rotatable with respect to the drum, a first driving motor to provide power to the pulsator, and a second driving motor to provide power to the drum.

The washing machine may further include a first shaft extending from the pulsator along a rotation axis of the pulsator, a first pulley connected to the first shaft, and a first belt connecting the first driving motor and the first pulley.

The washing machine may further include a second shaft extending from the drum along a rotation axis of the drum, a second pulley connected to the second shaft, and a second belt connecting the second driving motor and the second pulley.

The first pulley may be different in size from the second pulley.

Driving force of the first motor may be different from driving force of the second motor.

The second driving motor may be mounted on the rear surface of the tub and may include an annular stator and a rotor rotating with respect to the stator.

The first shaft may pass through the second driving motor and may be rotatable relative to the second driving motor.

The first pulley may include a first base portion radially extending from the first shaft at the rear of the second driving motor, a first extending portion extending from the first base portion toward the drum, and a first coupling portion provided at an end portion of the first extending portion and connected to the first belt.

The first extending portion may be provided to be inclined to be closer to the drum near a radially outer side of the first pulley.

A second rotational path of the second belt may be configured to be inside the first rotational path of the first belt when viewed from behind the drum.

The washing machine may further include an idler connected to the first belt, wherein the first driving motor, the first pulley, and the idler may be connected to the first belt, forming the first rotational path.

The first pulley may include a first base portion extending at the rear of the second driving motor in the radial direction of the first pulley, and a first coupling portion extending from the first base portion toward the drum to cover the second driving motor and to which the first belt is coupled.

The first driving motor may be configured to selectively rotate the pulsator in one of the same direction as the rotating direction of the drum and the opposite direction of the rotating direction of the drum.

The first shaft may be rotatably inserted into the second shaft.

The first pulley may be disposed to be spaced more from the drum than the second pulley is.

In accordance with another aspect of the present disclosure, a washing machine includes a main body having a laundry inlet, a tub provided inside the main body to store water, a drum rotatably installed inside the tub, a pulsator provided inside the drum and configured to be rotatable with respect to the drum, a first driving motor to provide power to the pulsator, a second driving motor to provide power to the drum, a first pulley configured to receive power from the first driving motor and deliver the power to the pulsator, and a second pulley configured to receive power from the second driving motor and deliver the power to the drum.

The washing machine may further include a first shaft connecting the pulsator and the first pulley, and a second shaft connecting the drum and the second pulley, wherein the first shaft may be rotatably inserted into the second shaft.

The first driving motor may be configured to selectively rotate the pulsator in one of the same direction as the rotating direction of the drum and the opposite direction of the rotating direction of the drum.

In accordance with still another aspect of the present disclosure, a washing machine include a main body having a laundry inlet, a tub provided inside the main body to store water, a drum rotatably installed inside the tub, a pulsator provided inside the drum and configured to be rotatable with respect to the drum, a first driving motor to provide power to the pulsator, a second driving motor to provide power to the drum, and a pulley configured to receive power from the first driving motor and deliver the power to the pulsator, wherein the second driving motor includes an annular stator and a rotor rotating with respect to the stator.

The first driving motor may be configured to selectively rotate the pulsator in one of the same direction as the rotating direction of the drum and the opposite direction of the rotating direction of the drum.

According to the present disclosure, a washing machine is provided with respective driving devices for driving a drum and a pulsator, thereby driving the drum and pulsator independently.

According to the present disclosure, the washing machine may drive the drum and the pulsator independently to improve washing performance and shorten the washing time.

According to the present disclosure, the washing machine may secure a washing space by not having a lifter that would be in the drum to lift the laundry.

DETAILED DESCRIPTION

Figure 1:
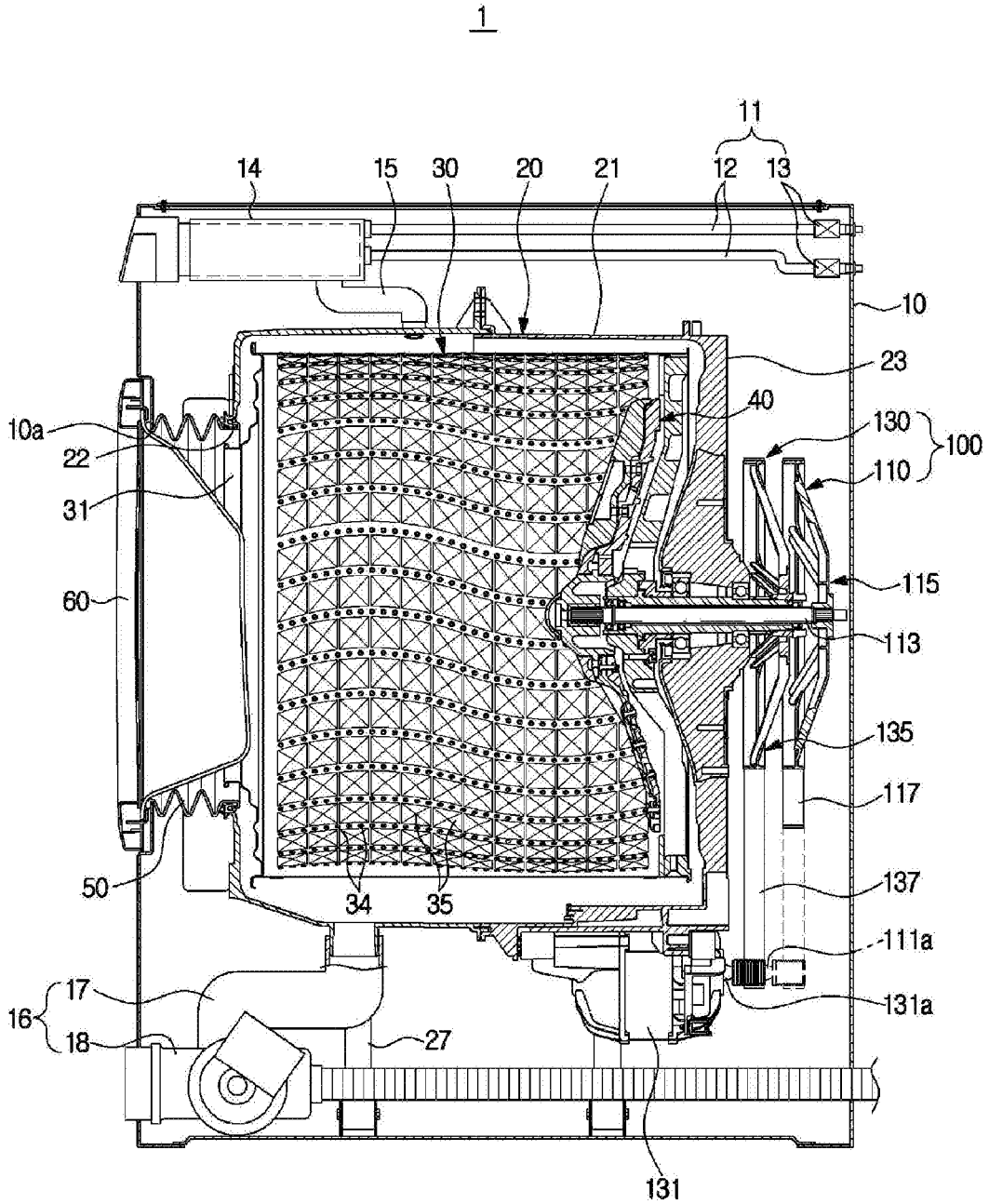
FIG. 1 is a side cross-sectional view illustrating a schematic configuration of a washing machine according to an embodiment of the present disclosure.

Configurations illustrated in embodiments and the drawings described in the present specification are merely examples, and thus it is to be understood that there may be various modifications that replace the embodiments and drawings.

Also, like reference numerals or symbols denoted in the drawings of the present disclosure represent members or components that perform substantially the same functions.

The terms herein used are for describing exemplary embodiments of the present disclosure. Accordingly, it should be apparent to those skilled in the art that the following description of exemplary embodiments of the present disclosure is provided for illustration purpose only and not for the purpose of limiting the present disclosure as defined by the appended claims and their equivalents. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, operations, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

The terms "forward" and "rear" and the like used in the following description are defined based on the drawings, and do not limit the shape and position of each component.

Hereinafter, a front loading type washing machine for throwing in laundry through the front of the washing machine will be described. However, the present disclosure is not limited to this type of washing machine, but is also applicable to a top loading type washing machine, in which laundry is loaded through the top of the washing machine.

Hereinafter, embodiments according to the present disclosure will be described with reference to the accompanying drawings in detail.

FIG. 1 is a side cross-sectional view illustrating a schematic configuration of a washing machine 1 according to an embodiment of the present disclosure.

Referring to FIG. 1, the washing machine 1 may include a main body 10 forming an outer appearance and accommodating various components therein, a tub 20 provided inside the main body 10 to store water, a drum 30 that receives and rotates the laundry, a pulsator 40 provided inside the drum 30, a first driving device 110 for driving the drum 30, and a second driving device 130 for driving the pulsator 40.

The main body 10 may have substantially a box shape. The main body 10 may have a front plate, a rear plate, a top plate, a bottom plate, and side plates. A laundry inlet 10*a* may be formed on the front plate to allow laundry to be thrown into the drum 30.

The laundry inlet 10*a* of the main body 10 may be opened or closed by a door 60. The door 60 may be pivotally coupled to the main body 10 by a hinge member. The door 60 may include a glass member and a door frame to support the glass member.

The glass member may be formed of a transparent tempered glass to allow the inside of the main body 10 to be seen from outside. The glass member may be provided to protrude toward the inside of the tub 20 to prevent the laundry from being biased toward the door 60 side.

The tub 20 may store water and may be formed in a substantially cylindrical shape. The tub 20 may be supported by a suspension 27. The tub 20 may include a hollow cylindrical portion 21, an opening 22 formed at one side of the cylindrical portion 21 to correspond to the laundry inlet 10*a* of the main body 10, and a bottom portion 23 formed on another side of the cylindrical portion 21.

Reinforcing ribs 24 (see FIG. 2) of a lattice shape may be formed in the bottom portion 23 of the tub 20 at predetermined intervals in the radial direction and the circumferential direction. The reinforcing ribs 24 may prevent warping when the tub 20 is injected and may prevent the rear wall of the tub 20 from being twisted by the load delivered to the tub 20 during washing or dewatering.

The laundry inlet 10*a* of the front plate of the main body 10 and the opening 22 of the tub 20 may be connected by a diaphragm 50. The diaphragm 50 may form a passage connecting the laundry inlet 10*a* of the front plate of the main body 10 and the opening 22 of the tub 20 and may direct the laundry thrown into the laundry inlet 10*a* to the inside of the drum 30 and may reduce transmission of vibration generated when the drum 30 is rotated to the main body 10. In addition, the diaphragm 50 may seal between the tub 20 and the glass member of the door 60.

The drum 30 may have a substantially cylindrical shape whose front portion is opened and may be rotatably provided inside the tub 20. That is, the drum 30 may include an opening 31 formed in the front. The drum 30 may be arranged such that the central axis of the drum 30 is parallel to the central axis of the tub 20.

The drum 30 is rotatable within the tub 20. The drum 30 may perform washing by raising and lowering the laundry while rotating. A plurality of through holes 34 may be formed around the drum 30 to allow water stored in the tub 20 to flow therethrough. In addition, the drum 30 may include at least one protrusion 35 protruding toward the inside of the drum 30. When the laundry is washed, the protrusions 35 may rub against the laundry to improve washing performance.

The drum 30 in this embodiment may be formed with a plurality of through holes 34 and/or protrusions 35 continuously formed along the circumferential surface of the drum 30 as no lifter is provided. That is, in the conventional washing machine, a lifter for lifting laundry is provided on a portion of the inner circumferential surface of the drum, and thus a plurality of through holes are not continuously formed along the circumferential surface of the drum. In other words, in the conventional washing machine, no through hole is formed at a portion where the lifter is provided. On the contrary, in the washing machine 1 according to the embodiment of the present disclosure, the plurality of through holes 34 and/or the protrusions 35 are continuously formed along the inner circumferential surface of the drum 30, securing more washing space and allowing more water stored in the tub 20 to flow into the drum 30, thereby improving washing performance.

The pulsator 40 may be disposed inside the rear of the drum 30 and may be provided rotatably with respect to the drum 30. The pulsator 40 may be configured to be rotatable independently of the drum 30. That is, the pulsator 40 may rotate in the same direction as the drum 30 or may rotate in a different direction from that of the drum 30. A rotation axis of the pulsator 40 may be the same as the rotation axis of the drum 30.

The pulsator 40 may generate water flow in the forward and backward directions inside the drum 30 during laundry. In the present disclosure, the pulsator 40 may improve the washing performance.

A water supply device 11 to supply water into the tub 20 may be provided at an upper portion of the tub 20. The water supply device 11 may include a water supply pipe 12 through which to supply water from an external water supply source and a water supply valve 13 to open or close the water supply pipe 12.

A detergent supply unit 14 to supply detergent to the tub 20 may be provided at a front upper portion of the main body 10. The detergent supply device 14 may be connected to the tub 20 through a connection pipe 15. The water supplied through the water supply pipe 12 may be supplied into the tub 20 together with the detergent via the detergent supply device 14.

The washing machine 1 may include a drainage device 16 capable of draining water from the tub 20. The drainage device 16 may include a drain pipe 17 connected to a lower portion of the tub 20 to guide the water to the outside of the main body 10, and a drainage pump 18 to pump the water in the tub 20.

Figure 2:
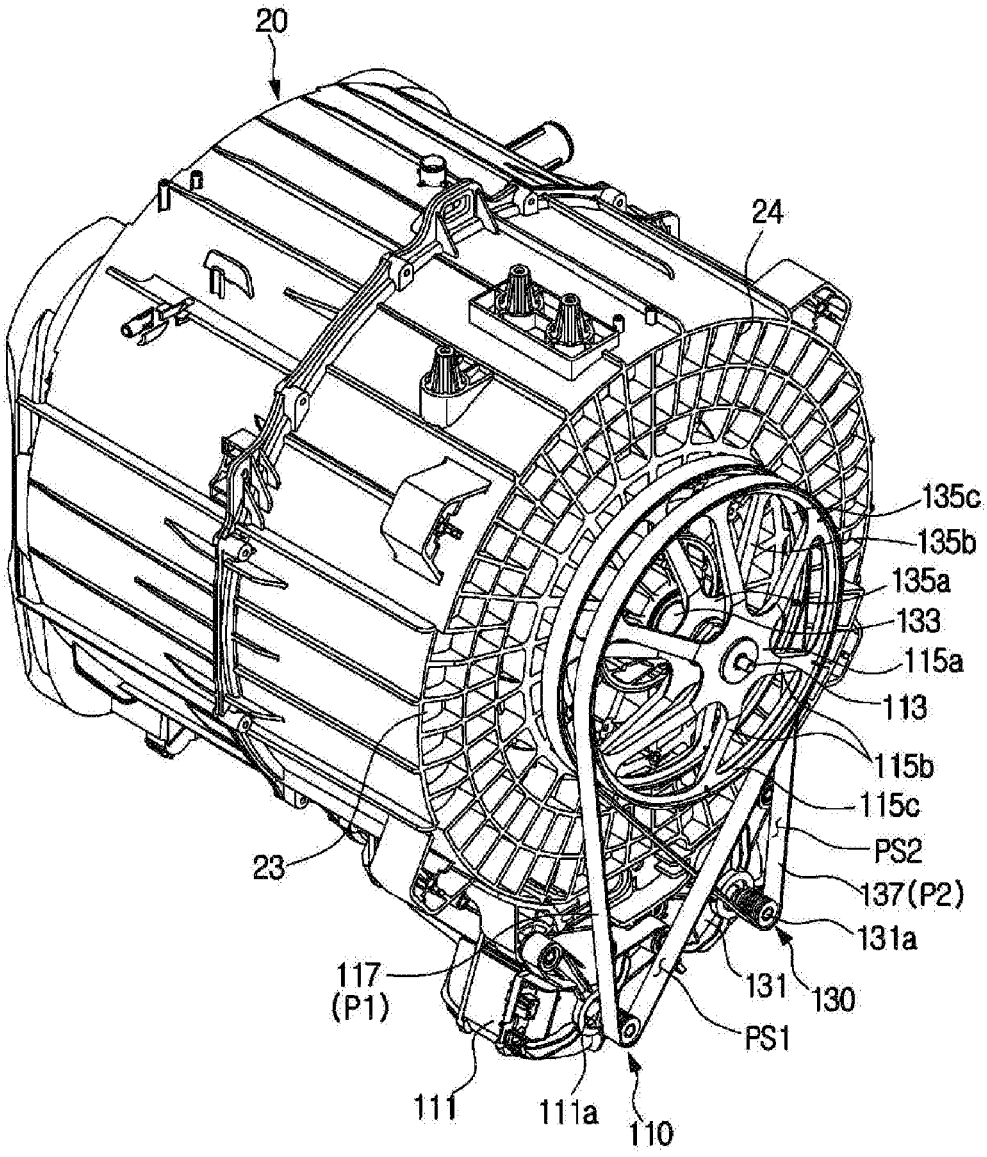
FIG. 2 is a perspective view illustrating a tub and a driving device of the washing machine shown in FIG. 1.
Figure 3:
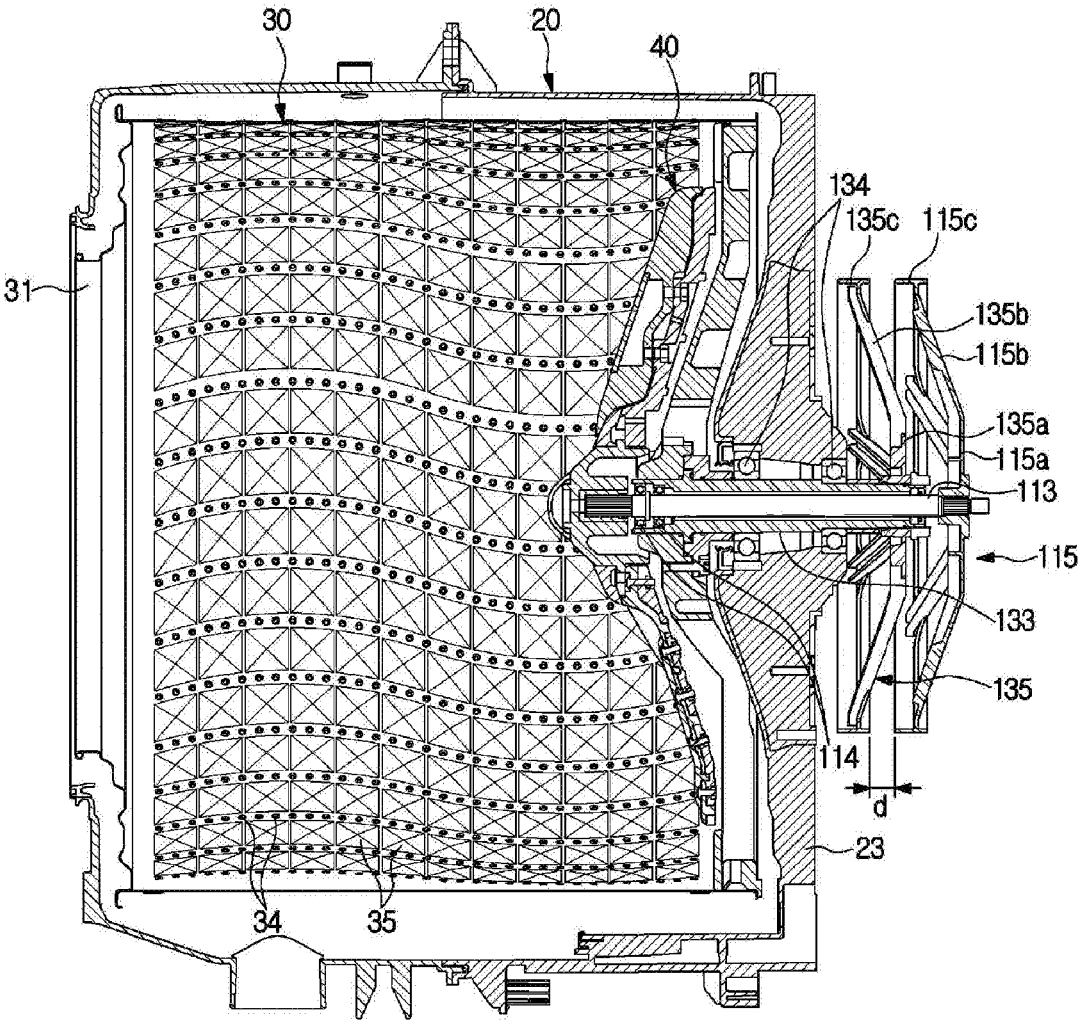
FIG. 3 is a side cross-sectional view illustrating a drum, a pulsator, and a driving device of the washing machine shown in FIG. 1.
Figure 4:
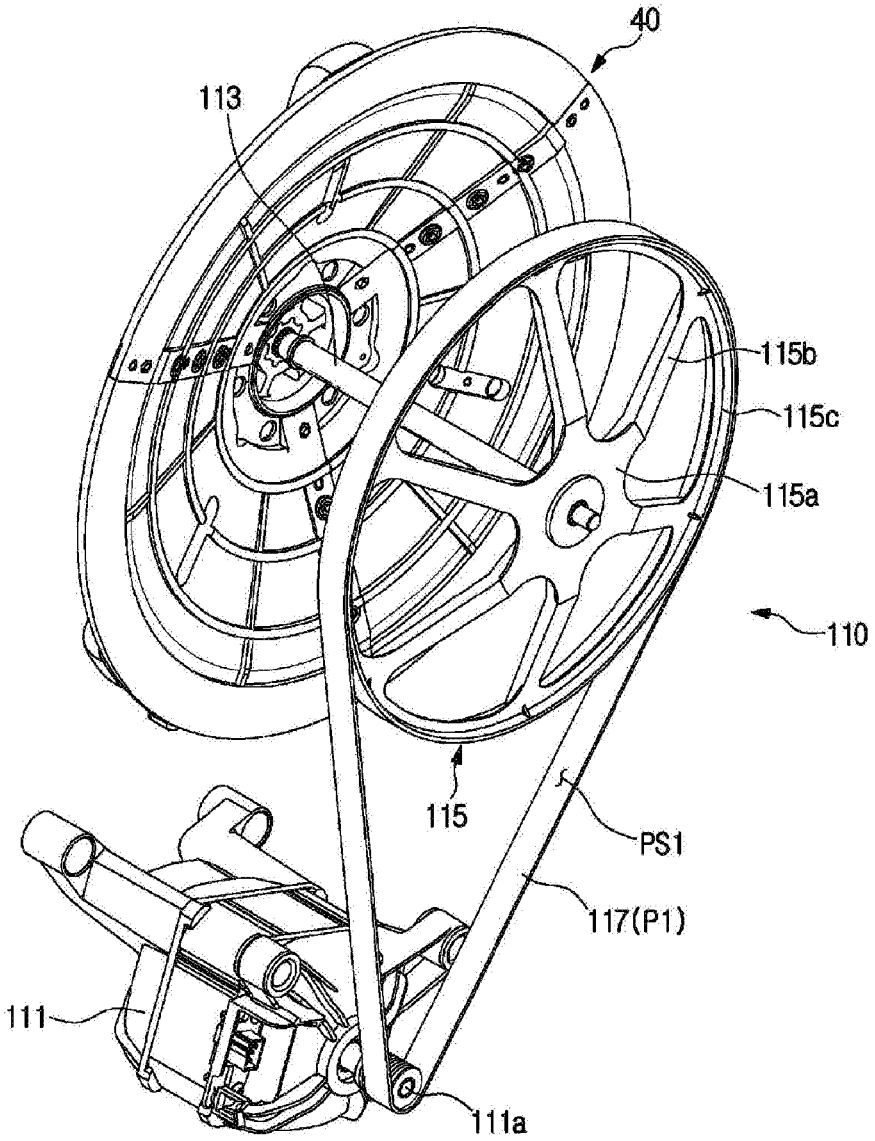
FIG. 4 is a perspective view illustrating a pulsator and a first driving device of the washing machine shown in FIG. 1.
Figure 5:
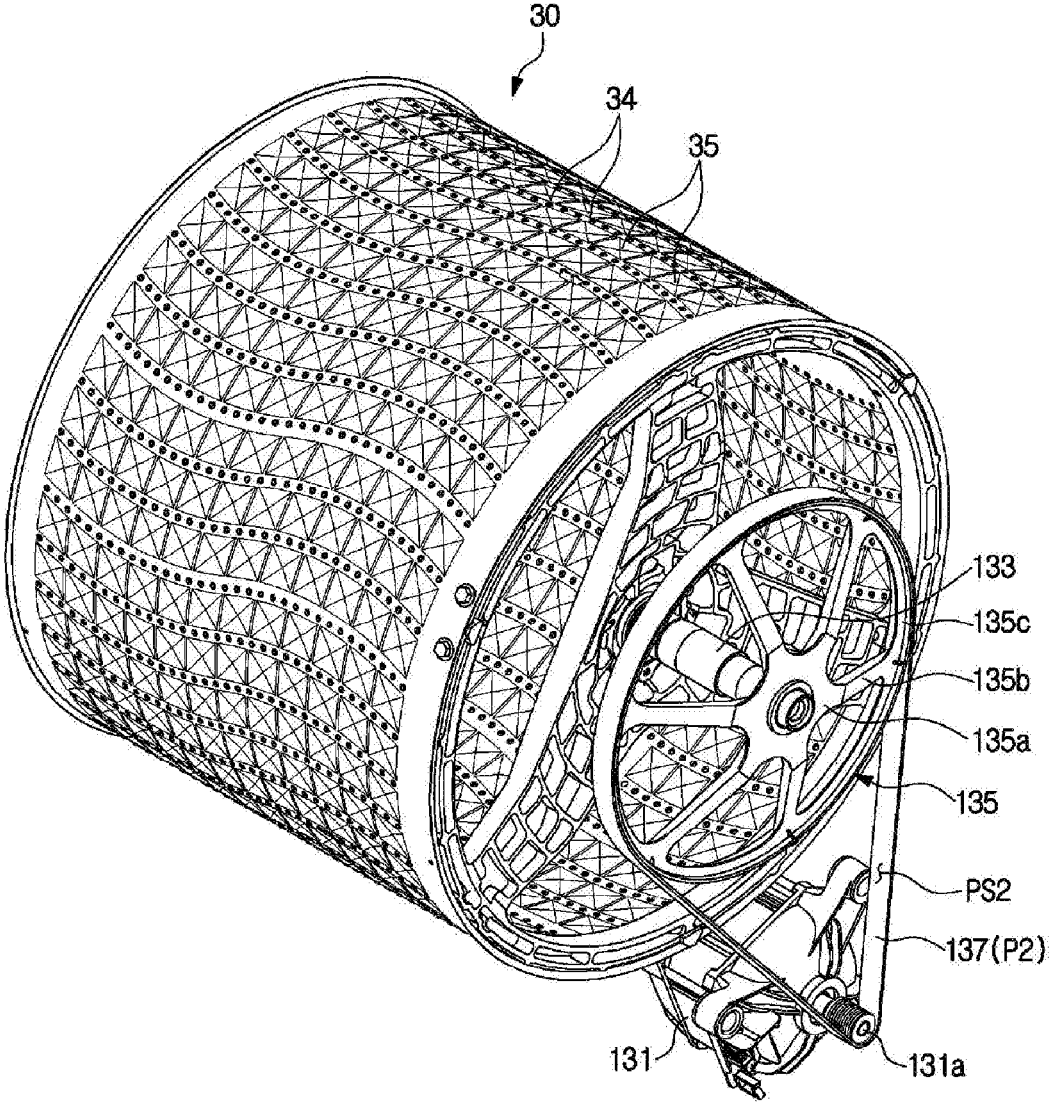
FIG. 5 is a perspective view illustrating a drum and a second driving device of the washing machine shown in FIG. 1.
Figure 6:
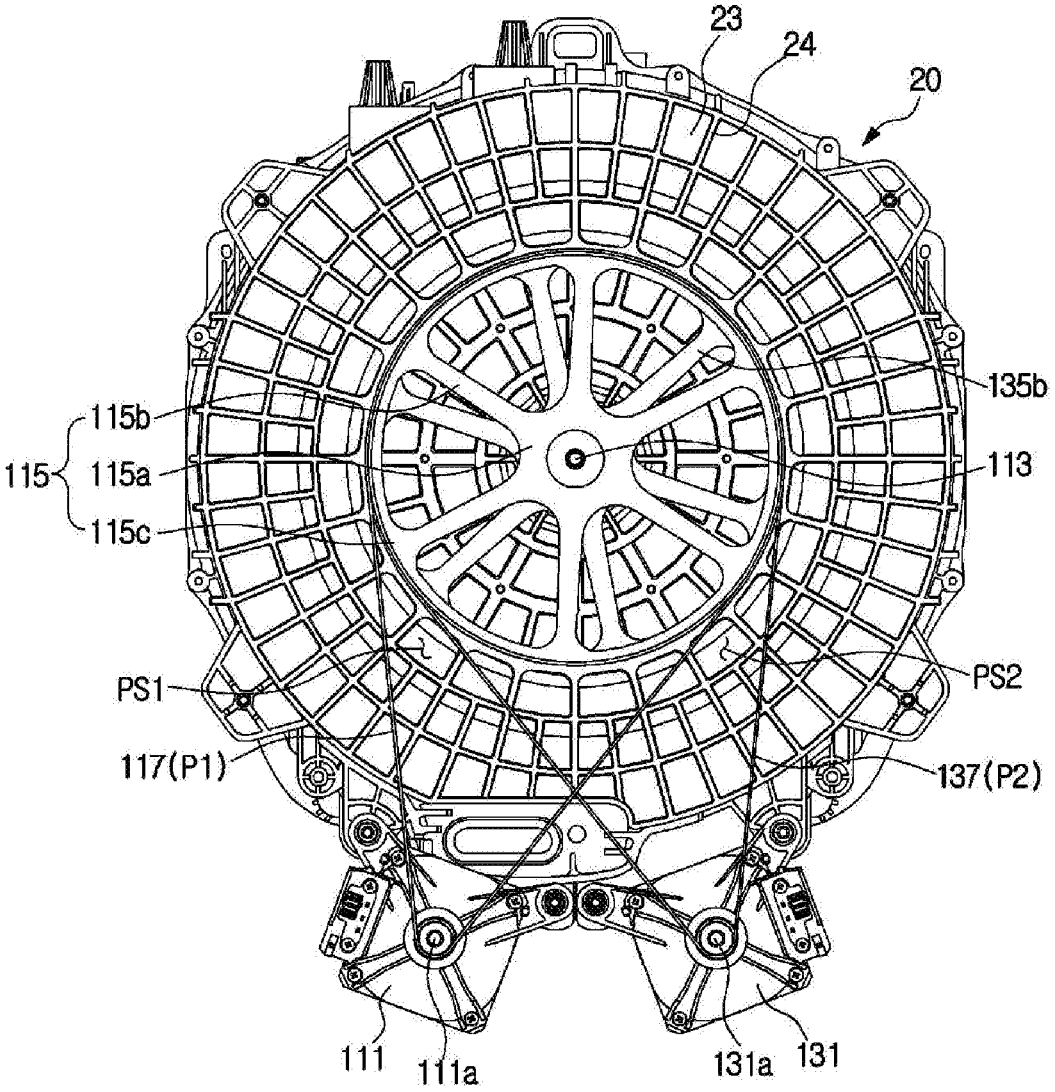
FIG. 6 is a rear view of the tub and the driving device shown in FIG. 2.

FIG. 2 is a perspective view illustrating a tub and a driving device of the washing machine 1 shown in FIG. 1. FIG. 3 is a side cross-sectional view illustrating the drum, the pulsator, and the driving device of the washing machine shown in FIG. 3. FIG. 4 is a perspective view illustrating the pulsator and the first driving device of the washing machine shown in FIG. 1. FIG. 5 is a perspective view illustrating the drum and the second driving device of the washing machine shown in FIG. 1. FIG. 6 is a rear view of the tub and the driving device shown in FIG. 2.

A driving device 100 including a first driving device 110 for providing power to the pulsator 40 and a second driving device 130 for providing power to the drum 30 is provided behind the tub 20.

The first driving device 110 may include a first driving motor 111 that generates a rotational force to rotate the pulsator 40, a first shaft 113 extending backward from the pulsator 40 and becoming the rotation axis of the pulsator 40, a first pulley 115 connected to the first shaft 113, and a first belt 117 connecting the first driving motor 111 and the first pulley 115.

The first driving motor 111 may be fixed to the outside of the tub 20 and may provide power to the pulsator 40. Specifically, the first driving motor 111 may be mounted on a portion of the lower end portion of the outer circumferential surface of the tub 20.

The first driving motor 111 may include a first motor shaft 111*a*, which may further extend to the rear of the main body 10 than the second motor shaft 131*a* of the second driving motor 131 described later. With this configuration, the washing machine according to the present embodiment may be configured such that a first rotational path P1 formed by the first belt 117 connected to the first motor shaft 111*a* does not overlap a second rotational path P2 formed by the second belt 137 connected to the second motor shaft 131*a*. That is, the first belt 117 may be disposed not to interfere with the second belt 137.

The first driving motor 111 may be a motor capable of both forward rotation and reverse rotation. Therefore, the first driving motor 111 may selectively rotate the pulsator 40 in one of the same direction as the rotational direction of the drum 30 and opposite direction to the rotational direction of the drum 30. The first driving motor 111 may be a Brushless Direct Current motor (BLDC motor).

The first shaft 113 may be connected to the rear surface of the pulsator 40 and may extend from the pulsator 40 along the rotation axis of the pulsator 40. That is, the first shaft 113 may extend to the rear of the pulsator 40. The first shaft 113 may be a rotation axis of the pulsator 40. The first shaft 113 may be formed separately from the pulsator 40 and coupled to the pulsator 40 without being limited thereto. For example, the first shaft 113 may be integrally formed with the pulsator 40.

A first bearing 114 to rotatably support the first shaft 113 may be provided on the outer circumferential surface of the first shaft 113. The first bearing 114 may be fixed to a second shaft 133.

One end portion of the first shaft 113 may be connected to the pulsator 40 and the other end portion of the first shaft 113 may be connected to the first pulley 115 as will be described later. According to this configuration, the first shaft 113 may rotate the pulsator 40 by delivering the power that the first pulley 115 receives from the first driving motor 111 to the pulsator 40.

The first shaft 113 may be rotatably inserted into the second shaft 133. Accordingly, the first shaft 113 may rotate in the same direction as the second shaft 133, or in the opposite direction to the second shaft 133.

The first shaft 113 may be longer than the second shaft 133 and may be inserted into the second shaft 133 to protrude from either ends portion of the second shaft 133. According to this configuration, the pulsator 40 connected to one end portion of the first shaft 113 may be disposed inside the drum 30 connected to one end portion of the second shaft 133 and the first pulley 115 connected to the other end portion of the first shaft 113 may be disposed at a farther distance from the drum 30 than the second pulley 135 connected to the other end portion of the second shaft 133 may be.

The first pulley 115 may be connected to the other end portion opposite of the one end portion of the first shaft 113 to which the pulsator 40 is connected. The first pulley 115 may include a first base portion 115*a* connected to the first shaft 113, a first coupling portion 115*b* coupled to the first belt 117 as will be described later to guide the rotation of the first belt 117, and a first extending portion 115*c* connecting the first base portion 115*a* and the first coupling portion 115*b*.

The first base portion 115*a* is fixed at the other end portion of the first shaft 113 so that the first shaft 113 rotates along with the first pulley 115 when the first pulley 115 rotates.

The first coupling portion 115*b* may be provided along the circumference of the first pulley 115 and may be connected to the first belt 117. The first coupling portion 115*b* is connected to the first belt 117 so that the first pulley 115 may receive the driving force generated from the first driving motor 111. The first pulley 115 may deliver the driving force received through the first coupling portion 115*b* to the first shaft 113 connected to the first base portion 115*a*.

At least one or more of the first extending portions 115*c* may extend along the radial direction of the first shaft 113 to connect the first base portion 115*a* and the first coupling portion 115*b*. However, unlike the embodiment shown in FIG. 4, the first extending portion 115*c* may be provided such that one plate extends from the first base portion 115*a* to the first coupling portion 115*b*. The first extending portion 115*c* may deliver the driving force received from the first coupling portion 115*b* to the first base portion 115*a*.

In other words, the first pulley 115 may receive power from the first driving motor 111 and deliver it to the pulsator 40. The first pulley 115 may be disposed at a farther distance from the drum 30 than the second pulley 135 may be, as will be described later.

The first belt 117 may deliver the power of the first driving motor 111 to the first pulley 115 by connecting the first driving motor 111 and the first pulley 115. Specifically, the inner surface of the first belt 117 may be in contact with and engaged with the first motor shaft 111*a* of the first driving motor 111 and the first coupling portion 115*b* of the first pulley 115. That is, rotation of the first belt 117 may be guided by the first motor shaft 111*a* of the first driving motor 111 and the first coupling portion 115*b* of the first pulley 115.

The first belt 117 may be spaced apart from the second belt 137 by a predetermined distance d. Accordingly, the second belt 137 may not be interfered with by the first belt 117.

The second driving device 130 may include a second driving motor 131 to generate a rotational force to rotate the drum 30, a second shaft 133 extending backward from the drum 30 and serving as a rotation axis of the drum 30, a second pulley 135 connected to the second shaft 133, a second belt 137 connecting the second driving motor 131 and the second pulley 135.

The second driving motor 131 may be fixed to the outside of the tub 20 and may provide power to the drum 30. Specifically, the second driving motor 131 may be mounted on a portion of the lower end portion of the outer circumferential surface of the tub 20 other than the portion to which the first driving motor 111 is fixed.

The second driving motor 131 may include a second motor shaft 131*a*, and the second motor shaft 131*a* may extend to the rear of the main body 10 less than the first motor shaft 111*a* of the first driving motor 111 may do. According to this configuration, the washing machine according to the present embodiment may be configured such that the second rotational path P2 formed by the second belt 137 connected to the second motor shaft 131*a* does not overlap the first rotational path P1 formed by the first belt 117 connected to the second motor shaft 131*a*. That is, the second belt 137 may be disposed not to interfere with the first belt 117. In other words, a first rotation plane PS1 formed by the first belt 117 may be provided not to overlap a second rotation plate PS2 formed by the second belt 137. Specifically, the first rotation plane PS1 may be substantially parallel to the second rotation plane PS2.

The second driving motor 131 may be a motor capable of both forward rotation and reverse rotation like the first driving motor 111. Accordingly, the second driving motor 131 may rotate the drum 30 in the first direction or in the second direction different from the first direction. The second driving motor 131 may be a BLDC motor like the first driving motor 111.

In this embodiment, the second driving motor 131 may be the same driving motor as the first driving motor 111. Specifically, the second driving motor 131 may be provided to have the same driving force as the driving force of the first driving motor 111.

The second shaft 133 may be connected to the rear surface of the drum 30 and may extend from the drum 30 along the rotation axis of the drum 30. That is, the second shaft 133 may extend backward from the drum 30. The second shaft 133 may be a rotation axis of the drum 30. The second shaft 133 may pass through the rear plate of the tub 20 to connect the drum 30 and the second pulley 135. The second shaft 133 may be formed separately from the drum 30 and coupled to the drum 30 without being limited thereto. For example, it may be integrally formed with the drum 30.

A second bearing 134 to rotatably support the second shaft 133 may be provided on the outer circumferential surface of the second shaft 133. The second bearing 134 may be fixed to the tub 20.

One end portion of the second shaft 133 may be connected to the drum 30 and the other end portion of the second shaft 133 may be connected to the second pulley 135, which will be described later. According to this configuration, the second shaft 133 may rotate the drum 30 as the second pulley 135 delivers the power received from the second driving motor 131 to the drum 30.

In addition, the second shaft 133 may have a hollow therein so that the first shaft 113 may be rotatably inserted to the second shaft 133. Specifically, the hollow of the second shaft 133 may be formed to have a diameter larger than that of the first shaft 113 by a predetermined size so that the first shaft 113 may be inserted to the hollow to be rotated in the hollow. According to this configuration, the second shaft 133 may be rotated in the same direction as the first shaft 113, or in the opposite direction of the first shaft 113.

The second shaft 133 may be shorter than the first shaft 113 so that the first shaft 113 protrudes from either end portions of the second shaft 133. According to this configuration, the rear plate of the drum 30 connected to one end portion of the second shaft 133 may be disposed rearward as compared with the pulsator 40 connected to one end portion of the first shaft 113, and the second pulley 135 connected to the other end portion of the second shaft 133 may be disposed closer to the drum 30 than the first pulley 115 connected to the other end portion of the first shaft 113 may be.

The second pulley 135 may be connected to the other end portion opposite of the one end portion of the second shaft 133 to which the drum 30 is connected. The second pulley 135 may include a second base portion 135*a* connected to the second shaft 133, a second coupling portion 135*b* coupled to the second belt 137 to guide the rotation of the second belt 137, which will be described later, and a second extension portion 135*c* connecting the second base portion 135*a* and the second coupling portion 135*b*.

The second base portion 135*a* is fixed to the other end portion of the second shaft 133, so that the second shaft 133 rotates along with the second pulley 135 when the second pulley 135 rotates.

The second coupling portion 135*b* may be provided along the circumference of the second pulley 135 and may be connected to the second belt 137. As the second coupling portion 135*b* is connected to the second belt 137, the second pulley 135 may receive the driving force generated by the second driving motor 131. The second pulley 135 may deliver the driving force received through the second coupling portion 135*b* to the second shaft 133 connected to the second base portion 135*a*.

At least one second extension portion 135*c* may extend along the radial direction of the second shaft 133 to connect the second base portion 135*a* and the second coupling portion 135*b*. However, unlike what is shown in FIG. 5, the second extension portion 135*c* may be provided such that one plate extends from the second base portion 135*a* to the second coupling portion 135*b*. The second extension portion 135*c* may deliver the driving force received from the second driving motor 131 to the second base portion 135*a*.

In other words, the second pulley 135 may receive power from the second driving motor 131 and deliver it to the drum 30. The second pulley 135 may be disposed closer to the drum 30 than the first pulley 115 may be.

In this embodiment, the second pulley 135 may be the same pulley as the first pulley 115. Specifically, the second pulley 135 may be provided to have the same size as that of the first pulley 115. That is, the second pulley 135 may have the same diameter as the diameter of the first pulley 115.

The second belt 137 may connect the second driving motor 131 and the second pulley 135 to deliver the power of the second driving motor 131 to the second pulley 135. Specifically, the inner surface of the second belt 137 may be in contact with and engaged with the second motor shaft 131*a* of the second driving motor 131 and the second coupling portion 135*b* of the second pulley 135. That is, rotation of the second belt 137 may be guided by the second motor shaft 131*a* of the second driving motor 131 and the second coupling portion 135*b* of the second pulley 135.

The second belt 137 may be spaced apart from the first belt 117 by a predetermined distance d. Accordingly, the second belt 137 may not interfere with the first belt 117.

In this embodiment, the second belt 137 may be the same belt as the first belt 117. Specifically, the second belt 137 may be provided to have a length equal to the length of the first belt 117.

In other words, the first driving motor 111, the first pulley 115 and the first belt 117 of the first driving device 110 of the washing machine 1 according to the present embodiment may be identical to the second driving motor 131, the second pulley 135, and the second belt 137 of the second driving device 130, respectively.

Hereinafter, operation of the washing machine 1 according to an embodiment of the present disclosure will be described.

The washing machine 1 according to an embodiment of the present disclosure may rotate the first driving motor 111 and the second driving motor 131 in opposite directions to rotate the drum 30 and the pulsator 40 in opposite directions during laundry. According to this operation, unlike the conventional washing machine that washes laundry by falling them only in the vertical direction, the washing machine 1 according to the embodiment of the present disclosure may wash the laundry by shifting the laundry not only in the vertical direction but also in the front-rear direction, and may also produce a water flow in a direction in which the laundry is twisted, thereby improving the washing performance and as a result, reducing the washing time.

On the other hand, the washing machine 1 according to another embodiment of the present disclosure may rotate the first driving motor 111 and the second driving motor 131 in the same direction in order to rotate the drum 30 and the pulsator 40 in the same direction during laundry. In this case, the washing machine 1 according to the embodiment of the present disclosure may perform the same operation as the conventional drum type washing machine.

The conventional washing machine is typically rotated at 45 rpm, and unable to do the laundry by falling if rotated at 75 RPM or more because the laundry is fixed to the inner circumferential surface of the drum by the centrifugal force. However, in the washing machine 1 in accordance with an embodiment of the present disclosure, with the pulsator 40 provided inside the drum 30, even if the drum 30 is rotated at high speed, the pulsator 40 drops the laundry, and thus the washing performance may be improved and the washing time may be reduced.

Figure 7:
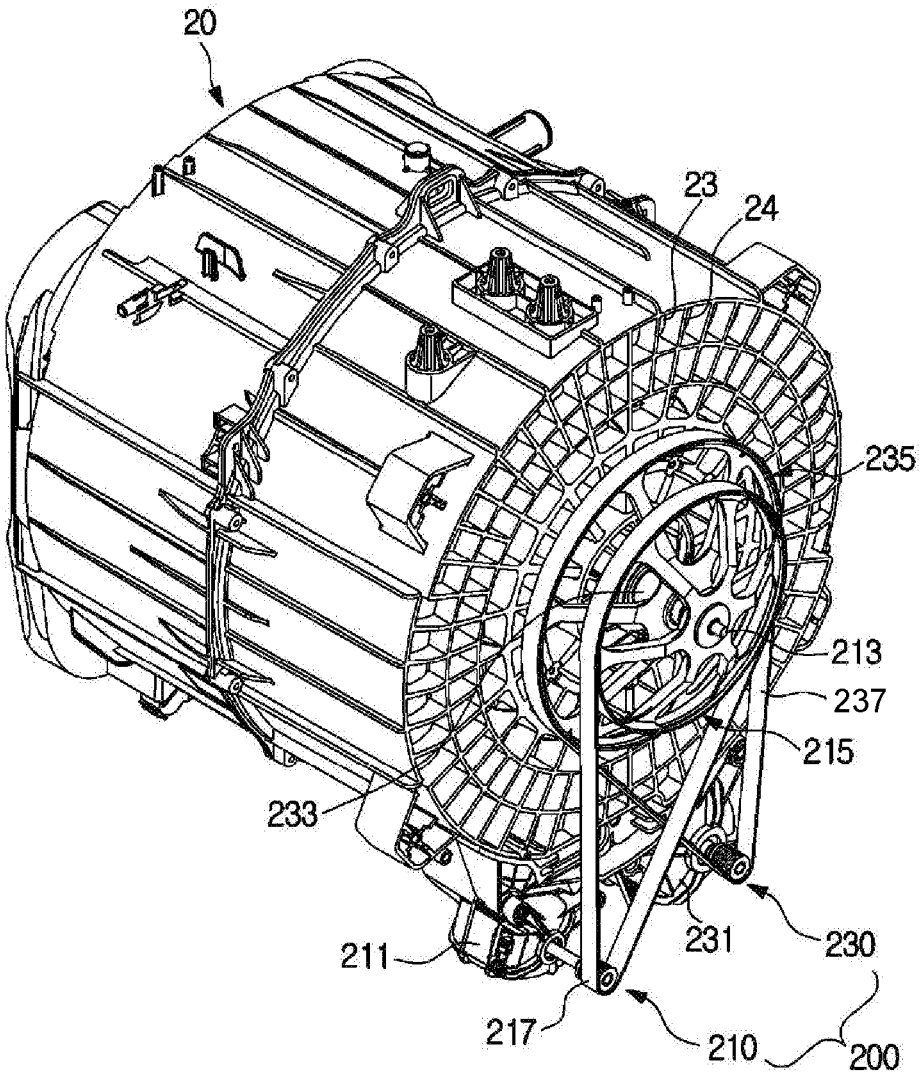
FIG. 7 is a perspective view illustrating a tub and a driving device of a washing machine according to another embodiment.

FIG. 7 is a perspective view illustrating a tub 20 and a driving device 200 of a washing machine according to another embodiment.

A driving device 200 according to another embodiment will be described with reference to FIG. 7. However, the same components as those in the embodiment shown in FIGS. 1 to 6 are denoted by the same reference numerals and description thereof may be omitted.

Referring to FIG. 7, the driving device 200 according to another embodiment of the present disclosure may include a first driving device 210 and a second driving device 230.

The first driving device 210 may include a first driving motor 211 to generate a rotational force for rotating the pulsator 40, a first shaft 213 extending rearward from the pulsator 40 and becoming the rotation axis of the pulsator 40, a first pulley 215 coupled to the first shaft 213, and a first belt 217 connecting the first driving motor 211 and the first pulley 215.

The first driving motor 211 of the first driving device 210 may be implemented with a motor having a less driving force than that of the first driving motor 111 of the first driving device 110 shown in FIGS. 1 to 6. Accordingly, the first driving motor 211 shown in FIG. 7 may have a smaller size than the first driving motor 111 shown in FIGS. 1 to 6.

Corresponding to the size of the first driving motor 211, the first pulley 215 may be smaller in size than the first pulley 115 of the first driving device 110 shown in FIGS. 1 to 6. That is, the radius of the first pulley 215 shown in FIG. 7 may be smaller than the radius of the first pulley 115 shown in FIGS. 1 to 6.

In addition, corresponding to the size of the first driving motor 211 and the first pulley 215, the first belt 217 may be smaller in size than the first belt 117 of the first driving device 110 shown in FIGS. 1 to 6. That is, the length and/or width of the first belt 217 shown in FIG. 7 may be smaller than the length and/or width of the first belt 117 shown in FIGS. 1 to 6.

The first shaft 213 may be connected to the rear surface of the pulsator 40 to be a rotation axis of the pulsator 40. The first shaft 213 shown in FIG. 7 may be identical to the first shaft 113 shown in FIGS. 1 to 6.

The second driving device 230 may include a second driving motor 231 to generate a rotational force to rotate the drum 30, a second shaft 233 extending rearward from the drum 30 and serving as a rotation axis of the drum 30, a second pulley 235 coupled to the second shaft 233, and a second belt 237 connecting the second driving motor 231 and the second pulley 235. The second driving device 230 shown in FIG. 7 may be the same as the second driving device 130 shown in FIGS. 1 to 6.

As described above, with the reduced size of some components of the first driving device 210 of the driving device 200 in the washing machine according to this embodiment of the present disclosure, more space may be secured inside the main body 10 and the material costs may be reduced. Although the first driving device 210 is illustrated as being reduced in size in FIG. 7, it is possible to have a device with the same size or smaller size than the first driving device 110 shown in FIGS. 1 to 6 for the first driving device 210 and a device with a smaller size than the second driving device 130 shown in FIGS. 1 to 6 for the second driving device 230.

In other words, the driving force of the first driving motor 211 may be different from the driving force of the second driving motor 231, the size of the first pulley 215 may be different from the size of the second pulley 235, and the length and/or width of the first belt 217 may be different from the length and/or width of the second belt 237.

Figure 8:
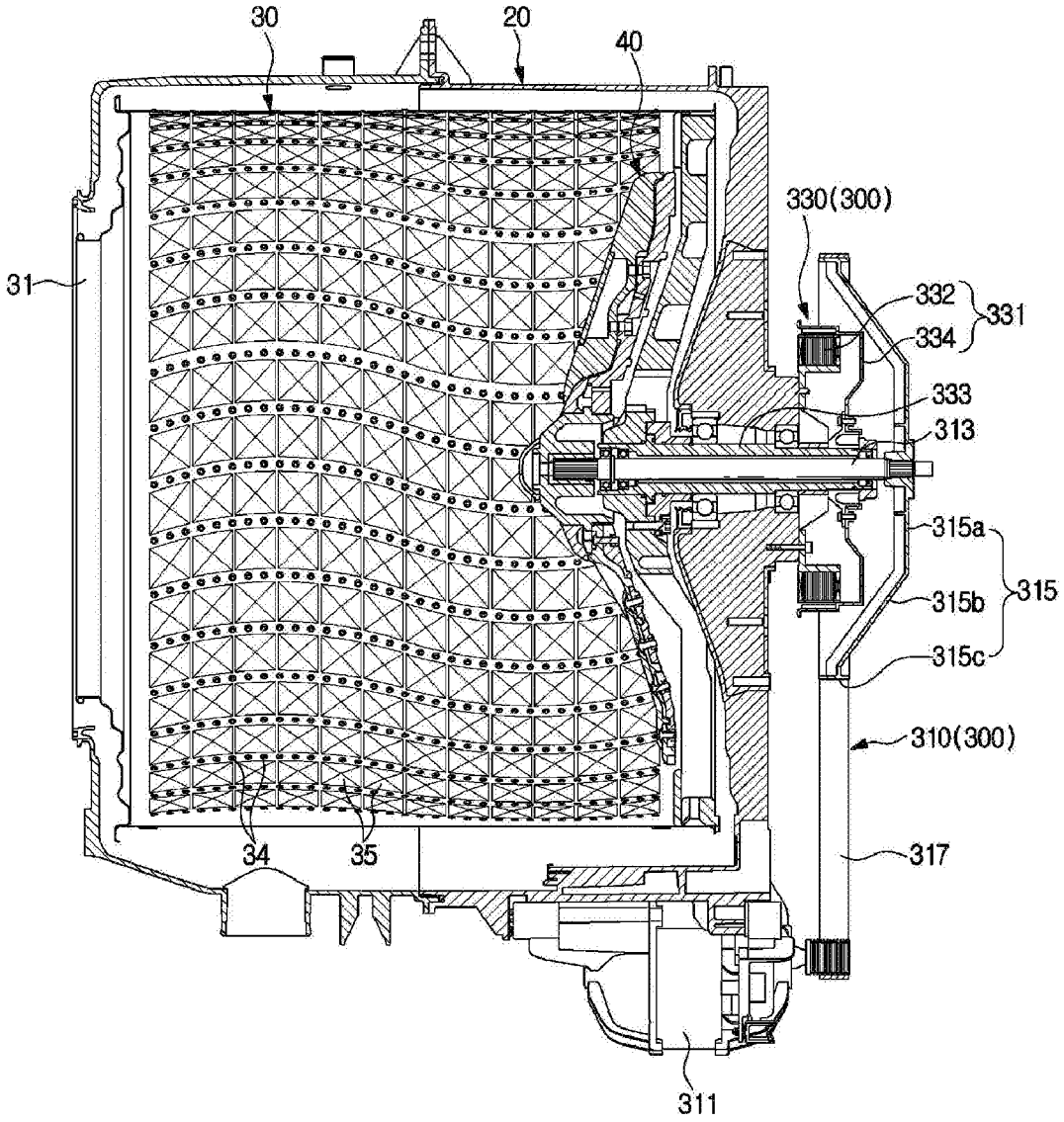
FIG. 8 is a side cross-sectional view illustrating a tub, a drum, a pulsator and a driving device of a washing machine according to another embodiment of the present disclosure.

FIG. 8 is a side cross-sectional view illustrating the tub 20, the drum 30, the pulsator 40 and a driving device 300 of a washing machine according to another embodiment of the present disclosure.

A driving device 300 according to another embodiment will be described with reference to FIG. 8. However, the same components as those in the embodiment shown in FIGS. 1 to 6 are denoted by the same reference numerals and description thereof may be omitted.

Referring to FIG. 8, the driving device 300 may include a first driving device 310 and a second driving device 330. Hereinafter, the second driving device 330 will be described first rather than the first driving device 310 for convenience of explanation.

The second driving device 330 to rotate the drum 30 of the driving device 300 may be mounted on the rear surface of the tub 20, and may include a second driving motor 331 and a second shaft 333.

The second driving motor 331 may include an annular stator 332 and a rotor 334 that rotates relative to the stator 332. According to this configuration, the second driving motor 331 may convert electric force into a mechanically rotational force by the stator 332 and the rotor 334. In addition, the second driving motor 331 according to the embodiment shown in FIG. 8 may be directly connected to the drum 30 via the second shaft 333 without a medium such as the second pulley 135, unlike the second driving motor 131 shown in FIGS. 1 to 6.

The stator 332 may be fixed to the tub 20, and the rotor 334 may be rotated by electromagnetic interaction with the stator 332. The rotor 334 may be provided to cover the outside of the stator 332.

The rotational force generated by the stator 332 and the rotor 334 may be delivered to the drum 30 through the second shaft 333. The second shaft 333 may be connected to the rotor 334 and rotated along with the rotor 334, and may penetrate the rear plate of the tub 20 to connect the drum 30 and the rotor 334.

The second shaft 333 may have a hollow formed therein to allow the first shaft 313 to be rotatably inserted thereto. That is, the first shaft 313 may be provided to be rotatable with respect to the second driving motor 331 while passing through the second driving motor 331. According to this configuration, the second shaft 333 may be rotated in the same direction as the first shaft 313 or in the opposite direction to the first shaft 313.

The first driving device 310 may include a first driving motor 311 that generates a rotational force for rotating the pulsator 40, a first shaft 313 extending rearward from the pulsator 40 and becoming the rotation axis of the pulsator 40, a first pulley 315 coupled to the first shaft 313, and a first belt 317 connecting the first driving motor 311 and the first pulley 315. The first driving motor 311, the first shaft 313 and the first belt 317 in the configuration of the first driving device 310 shown in FIG. 8 may be identical to the first driving motor 111, the first shaft 113, and first belt 117 of the first driving device 110 shown in FIGS. 1 to 6, respectively.

The first pulley 315 of the first driving device 310 shown in FIG. 8 may be provided to cover the second driving motor 331. Specifically, the first pulley 315 may include a first base portion 315*a* extending radially from the first shaft 313 at the rear of the second driving motor 331, a first extending portion 315*b* extending from the first base portion 315*a* to the drum 30, and a first coupling portion 315*c* provided at an end of the first extending portion 315*b* and connected to the first belt 317.

The first extending portion 315*b* may be inclined to be closer to the drum 30 near the outer side in the radial direction of the first pulley 315. However, although not shown, the first extending portion 315*b* may be provided to extend toward the drum 30 by being bent by 90 degrees from the first base portion 315*a*.

According to this configuration, the first belt 317 may be connected to the first pulley 315 at a position adjacent to the drum 30.

The washing machine according to the embodiment shown in FIG. 8 may secure the internal space of the main body 10 by providing the second driving device 330 of the driving device 300 as a direct driving device and changing the shape of the first pulley 315 of the first driving device 310. In addition, the washing machine according to the embodiment shown in FIG. 8 may reduce the number of expensive BLDC motors applied to the driving device 300, thereby reducing the material cost. In addition, although the second driving device 330 is shown as a direct driving device in FIG. 8, the first driving device 310 may be a direct driving device.

Figure 9:
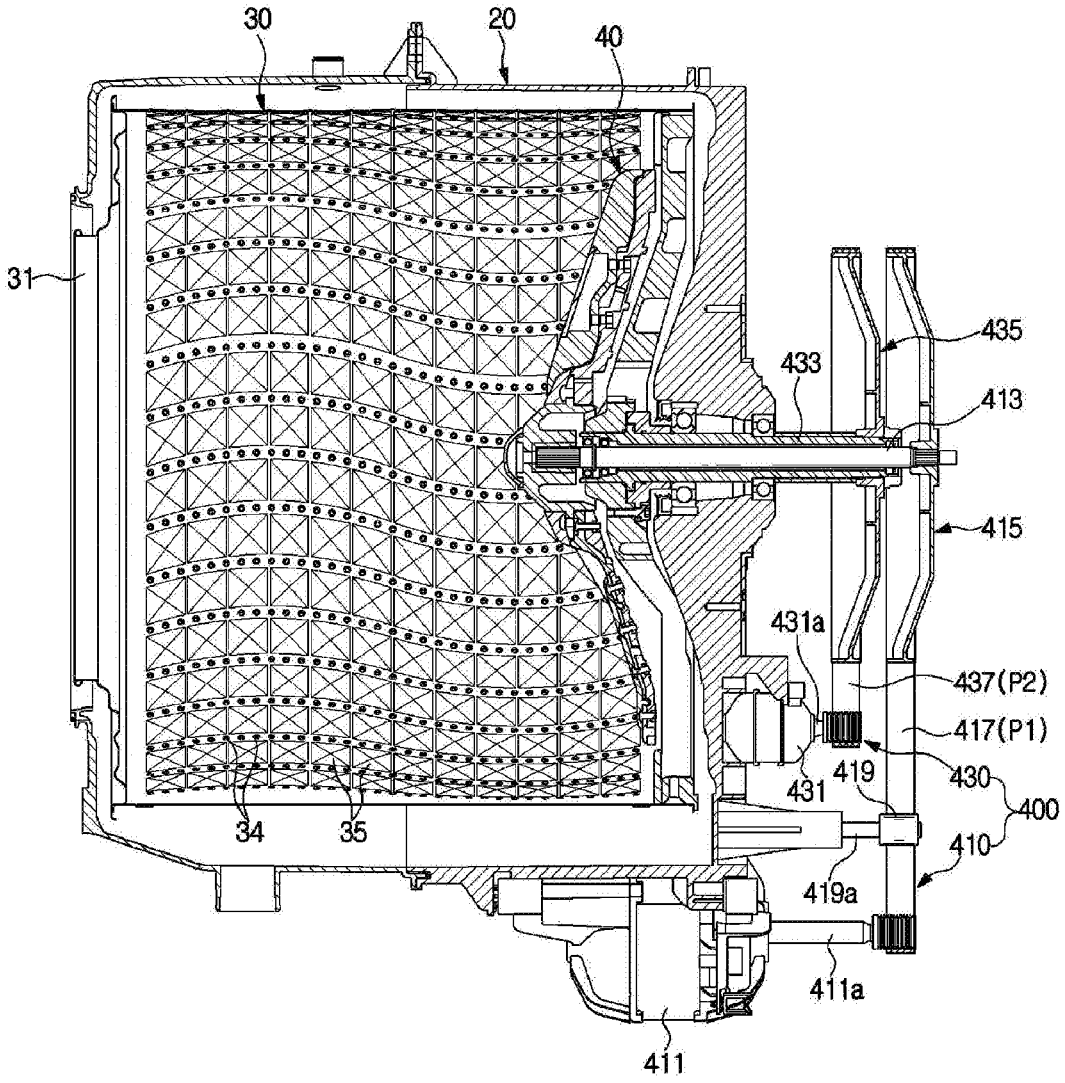
FIG. 9 is a side cross-sectional view illustrating a tub, a drum, a pulsator and a driving device of a washing machine according to another embodiment of the present disclosure.
Figure 10:
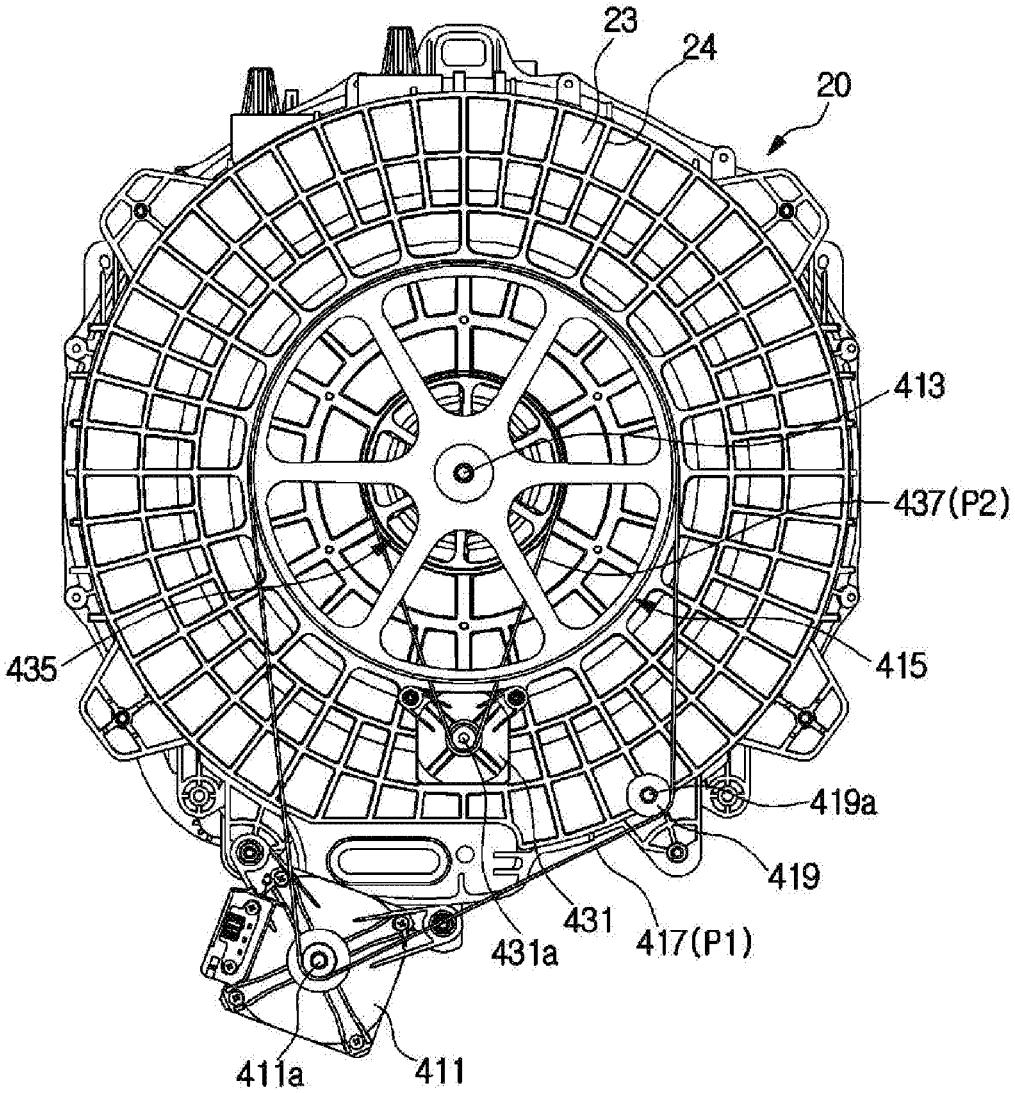
FIG. 10 is a schematic rear view of the tub, drum, and driving device of the washing machine according to the embodiment shown in FIG. 9.

FIG. 9 is a side cross-sectional view illustrating the tub 20, the drum 30, the pulsator 40 and a driving device 400 of a washing machine according to another embodiment of the present disclosure. FIG. 10 is a view schematically illustrating a rear surface of the tub 20, drum 30, and driving device 400 of the washing machine according to the embodiment shown in FIG. 9.

The driving device 400 will be described with reference to FIGS. 9 and 10. However, the same components as those in the embodiment shown in FIGS. 1 to 6 are denoted by the same reference numerals and description thereof may be omitted.

Referring to FIGS. 9 and 10, the driving device 400 may include a first driving device 410 and a second driving device 430.

The first driving device 410 may include a first driving motor 411 that generates a rotational force for rotating the pulsator 40, a first shaft 413 extending rearward from the pulsator 40 and becoming the rotation axis of the pulsator 40, a first pulley 415 coupled to the first shaft 413, a first belt 417 that delivers the driving force generated by the first driving motor 411 to the first pulley 415, and an idler 419 connected to the first belt 417.

The first driving motor 411 may be mounted on the lower end of the outer circumferential surface of the tub 20, and may have a first motor shaft 411*a*. The first belt 417 may be connected to the first motor shaft 411*a*.

The pulsator 40 may be fixed to one end portion of the first shaft 413 and the first pulley 415 may be fixed to the other end portion.

The first pulley 415 may be disposed in the rear of the drum 30 and may be connected to the first belt 417.

The first belt 417 may be connected to the first motor shaft 411*a*, the first pulley 415 and the idler 419, which will be described later, to form the first rotational path P1. The washing machine 1 according to the embodiment shown in FIGS. 1 to 6 is provided such that the first rotational path P1 formed by the first belt 117 and the second rotational path P2 formed by the second belt 137 partly overlap each other when viewed from behind the drum 30, but the washing machine according to the embodiment shown in FIGS. 9 and 10 may be provided such that the first rotational path P1 formed by the first belt 417 and the second rotational path P2 formed by the second belt 437 do not overlap when viewed from behind the drum 30. Specifically, the washing machine shown in FIGS. 9 and 10 may be configured such that the second rotational path P2 formed by the second belt 437 is provided inside the first rotational path P1 formed by the first belt 417 when viewed from behind the drum 30.

In the case of the washing machine 1 according to the embodiment shown in FIGS. 1 to 6, the first belt 117 is spaced apart from the second belt 137 by a predetermined distanced along the front-rear direction of the drum 30, but the first belt 117 or the second belt 137 is slipped with respect to the first pulley 115 or the second pulley 135 as it is driven for a long time, and moved in the forward and back ward directions of the drum 30. In this case, the first belt 117 and the second belt 137 may interfere with each other in the overlapping portion when viewed from behind the drum 30, which may reduce the reliability of the washing machine 1.

To solve this problem, the washing machine according to the embodiment shown in FIGS. 9 and 10 may be configured such that a second rotational path P2 formed by the second belt 437 is disposed inside the first rotational path P1 formed by the first belt 417 when viewed from behind the drum 30. Accordingly, the washing machine shown in FIGS. 9 and 10 may prevent the first belt 417 from interfering with the second belt 437.

The idler 419 may be provided to be connected to the first belt 417. Specifically, the idler 419 may be rotatably provided on an idler shaft 419*a* mounted on and fixed to the tub 20. At this time, the idler shaft 419*a* may be arranged to form a substantially triangular shape together with the first motor shaft 411*a* and the first shaft 413 when viewed from behind the drum 30. Accordingly, when viewed from behind the drum 30, the first rotational path P1 may have a rounded triangular shape.

The second driving device 430 may include a second driving motor 431 to generate a rotational force to rotate the drum 30, a second shaft 433 extending rearward from the drum 30 and serving as a rotation axis of the drum 30, a second pulley 435 coupled to the second shaft 433, and a second belt 437 connecting the second driving motor 431 and the second pulley 435.

The second driving motor 431 may be mounted on the rear surface of the tub 20 and may have a second motor shaft 431*a*. Alternatively, the second driving motor 431 may be mounted on the lower end of the outer circumferential surface of the tub 20 so that the second rotational path P2 is disposed inside the first rotational path P1. The second belt 437 may be connected to the second motor shaft 431*a*. The second driving motor 431 may be smaller in size than the first driving motor 411.

The second shaft 433 may be fixed to the drum 30 at one end portion of the second shaft 433 and may be fixed to the second pulley 435 at the other end portion of the second shaft 433. A hollow may be formed inside the second shaft 433, and the first shaft 413 may be rotatably inserted into the hollow.

The second pulley 435 may be disposed behind the drum 30 and connected to the second belt 437. The second pulley 435 may be smaller in size than the first pulley 415.

The second belt 437 may be connected to the second motor shaft 431*a* and the second pulley 435 to form a second rotational path P2. The second rotational path P2 may have an approximately elliptical shape when viewed from behind the drum 30. As described above, the second rotational path P2 may be provided inside the first rotational path P1.

The second belt 437 may be provided with a shorter and/or narrower width than the first belt 417 is because the second driving motor 431 and the second pulley 435 are provided at a smaller size than the first driving motor 411 and the first pulley 415.

Since the second driving motor 431 and the second pulley 435 are smaller than the first driving motor 411 and the first pulley 415, the washing machine of the embodiment shown in FIGS. 9 and 10 may secure an internal space.

Figure 11:
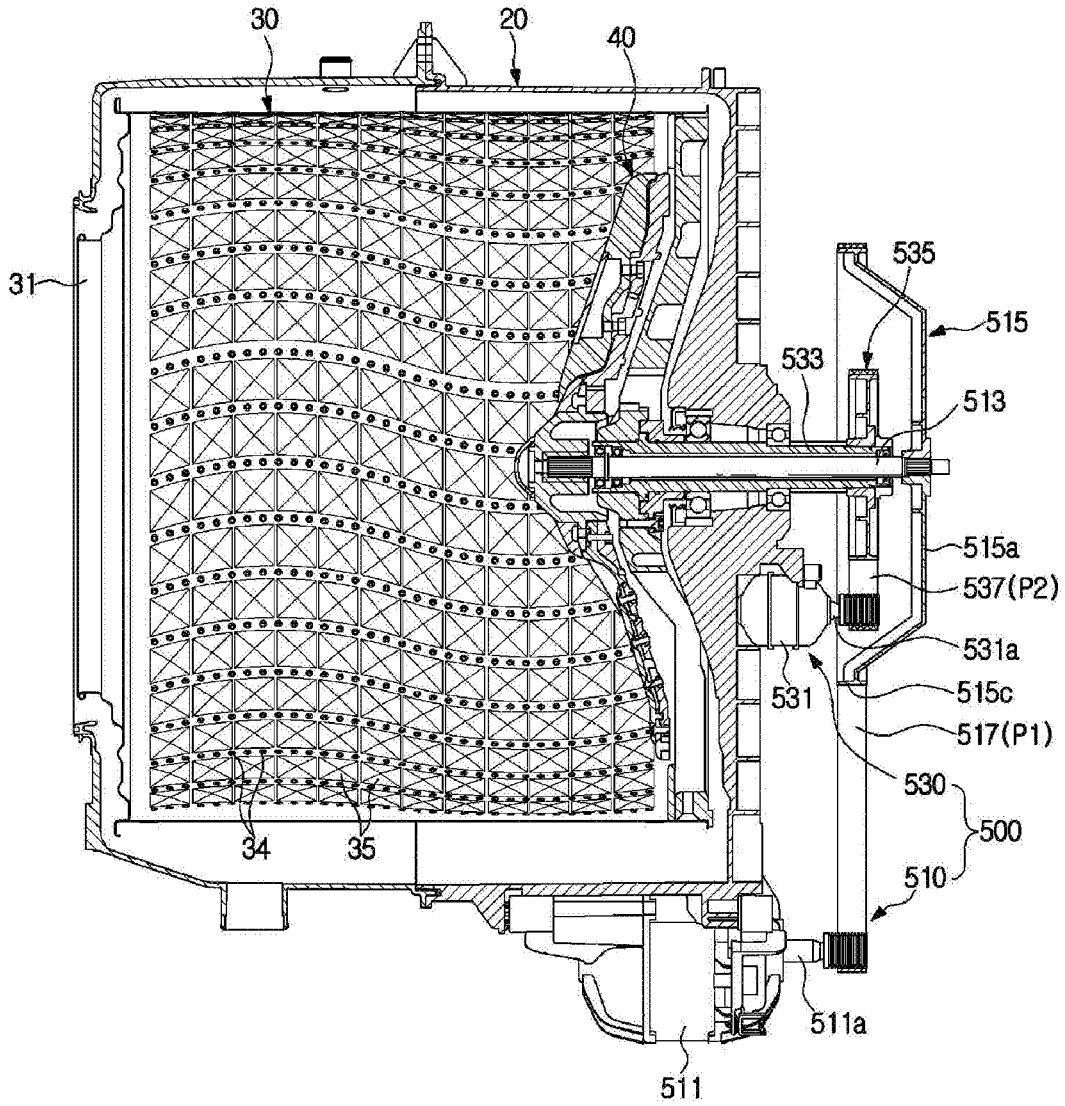
FIG. 11 is a side cross-sectional view illustrating a tub, a drum, a pulsator and a driving device of a washing machine according to another embodiment of the present disclosure.
Figure 12:
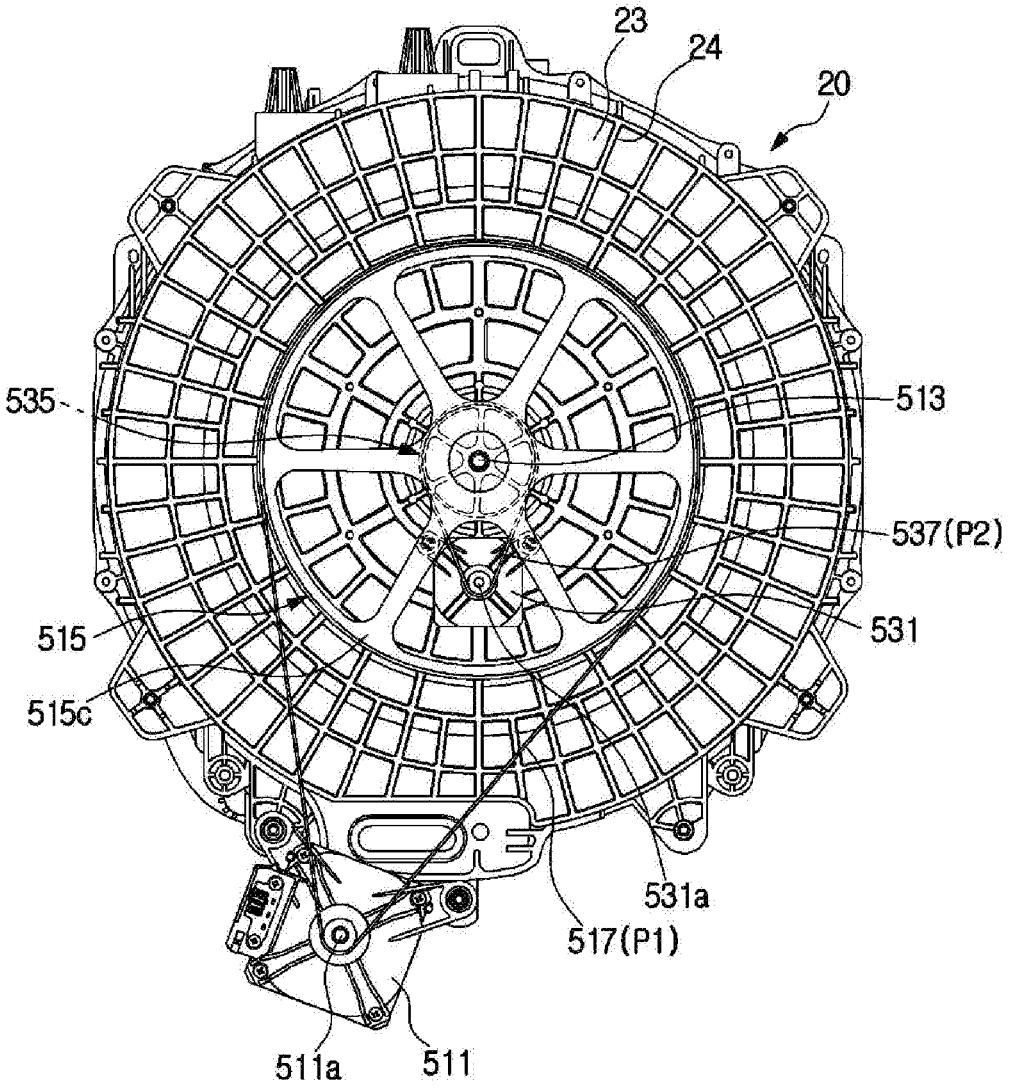
FIG. 12 is a schematic rear view of the tub, the drum, and the driving device of the washing machine according to the embodiment shown in FIG. 11.

FIG. 11 is a side cross-sectional view illustrating the tub 20, the drum 30, the pulsator 40 and a driving device 500 of a washing machine according to another embodiment of the present disclosure. FIG. 12 is a view schematically illustrating a rear surface of the tub 20, the drum 30, and the driving device 500 of the washing machine according to the embodiment shown in FIG. 11.

The driving device 500 will be described with reference to FIGS. 11 and 12. However, the same components as those in the embodiment shown in FIGS. 1 to 6 are denoted by the same reference numerals and description thereof may be omitted.

Referring to FIGS. 11 and 12, the driving device 500 may include a first driving device 510 and a second driving device 530.

The first driving device 510 may include a first driving motor 511 that generates a rotational force to rotate the pulsator 40, a first shaft 513 extending rearward from the pulsator 40 and becoming the rotation axis of the pulsator 40, a first pulley 515 coupled to the first shaft 513, and a first belt 517 that delivers the driving force generated in the first driving motor 511 to the first pulley 515.

The first driving motor 511 may be mounted on the lower end portion of the outer circumferential surface of the tub 20 and may have a first motor shaft 511*a*. The first belt 517 may be connected to the first motor shaft 511*a*.

The pulsator 40 may be fixed to one end portion of the first shaft 513 and the first pulley 515 may be fixed to the other end portion of the first shaft 513.

The first pulley 515 may be disposed behind the drum 30 and connected to the first belt 517. The first pulley 515 may include a first base portion 515*a* extending in the radial direction of the first pulley 515 behind the second driving motor 531, and a first coupling portion 515*c* extending from the first base portion 515*a* toward the drum 30 to cover the second driving motor 531 and to which the first belt 517 is coupled. The first coupling portion 515*c* may extend toward the drum 30 by being bent at approximately 90 degrees at the radially outer end of the first base portion 515*a*. The first coupling portion 515*c* may be inclined to be closer to the drum 30 near the radially outer side of the first shaft 513. With this configuration, the first belt 517 coupled to the first coupling portion 515*c* may be rotated on the same rotation plane as the rotation plane formed by the second belt 537. In addition, since the second driving motor 531 and the second pulley 535 are both disposed inside the first pulley 515, the second belt 537 is rotated inside the first pulley 515. Accordingly, the washing machine shown in FIGS. 11 and 12 may prevent the first belt 517 and the second belt 537 from interfering with each other.

In addition, the first pulley 515 may include a first extending portion that connects the first base portion 515*a* and the first coupling portion 515*c*, like the first pulley 315 in the embodiment shown in FIG. 8.

The first belt 517 may be connected to the first motor shaft 511*a* and the first pulley 515 to form a first rotational path P1. At this time, as in the embodiment shown in FIGS. 9 and 10, the washing machine according to the embodiment shown in FIGS. 11 and 12 may be provided such that the first rotational path P1 formed by the first belt 517 and the rotational path P2 formed by the second belt 537 do not overlap. Specifically, the washing machine shown in FIGS. 11 and 12 may be configured such that the second rotational path P2 formed by the second belt 537 is provided inside the first rotational path P1 formed by the first belt 517 when viewed from behind the drum 30. Accordingly, the washing machine shown in FIGS. 11 and 12 may prevent the first belt 517 from interfering with the second belt 537. The first rotational path P1 may have an approximately elliptical shape when viewed from behind the drum 30.

The second driving device 530 may include a second driving motor 531 to generate a rotational force to rotate the drum 30, a second shaft 533 extending rearward from the drum 30 and serving as a rotation axis of the drum 30, a second pulley 535 coupled to the second shaft 533, and a second belt 537 connecting the second driving motor 531 and the second pulley 535.

The second driving motor 531 may be mounted on the rear surface of the tub 20 and may have a second motor shaft 531*a*. Alternatively, the second driving motor 531 may be mounted on the lower end portion of the outer circumferential surface of the tub 20 so that the second rotational path P2 is disposed inside the first rotational path P1. The second belt 537 may be connected to the second motor shaft 531*a*. The second driving motor 531 may be smaller than the first driving motor 511.

The second shaft 533 may be fixed to the drum 30 at one end portion of the second shaft 533 and to the second pulley 435 at the other end portion of the second shaft 533. A hollow may be formed inside the second shaft 533, and the first shaft 513 may be rotatably inserted into the hollow.

The second pulley 535 may be disposed behind the drum 30 and connected to the second belt 537. The second pulley 535 may be smaller in size than the first pulley 515 so as to be disposed inside the first pulley 515.

The second belt 537 may be connected to the second motor shaft 531*a* and the second pulley 535 to form a second rotational path P2. The second rotational path P2 may have an approximately elliptical shape when viewed from behind the drum 30. As described above, the second rotational path P2 may be provided inside the first rotational path P1.

The second belt 537 may be provided with a shorter and/or narrower width than the first belt 517 because the second driving motor 531 and the second pulley 535 are provided in a smaller size than the first driving motor 511 and the first pulley 515.

Since the second driving motor 531 and the second pulley 535 are smaller than the first driving motor 511 and the first pulley 515, the washing machine of the embodiment shown in FIGS. 11 and 12 may secure an internal space.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. A washing machine, comprising:
- a main body having a laundry inlet on a front portion;
- a tub provided inside the main body to store water;
- a drum rotatably installed inside the tub;
- a pulsator provided inside the drum and configured to be rotatable with respect to the drum;
- a first pulley connected to the pulsator;
- a second pulley connected to the drum, wherein a diameter of the first pulley is the same as a diameter of the second pulley;
- a first driving motor to provide power to the pulsator; and
- a second driving motor to provide power to the drum.

2. The washing machine of claim 1, further comprising:
- a first shaft extending from the pulsator along a rotation axis of the pulsator, wherein the first shaft connects the pulsator to the first pulley; and
- a first belt connecting the first driving motor and the first pulley.

3. The washing machine of claim 2, further comprising:
- a second shaft extending from the drum along a rotation axis of the drum, wherein the second shaft connects the pulsator to the second pulley; and
- a second belt connecting the second driving motor and the second pulley.

4. The washing machine of claim 3, wherein the first pulley is different in size from the second pulley.

5. The washing machine of claim 3, wherein driving force of the first driving motor is different from driving force of the second driving motor.

6. The washing machine of claim 2, wherein the second driving motor is mounted on a rear surface of the tub and includes an annular stator and a rotor rotating with respect to the annular stator.

7. The washing machine of claim 6, wherein the first shaft passes through the second driving motor and is rotatable relative to the second driving motor.

8. The washing machine of claim 6, wherein the first pulley comprises:

a first base portion radially extending from the first shaft at a rear of the second driving motor;

a first extending portion extending from the first base portion toward the drum; and a first coupling portion provided at an end portion of the first extending portion and connected to the first belt.

9. The washing machine claim 8, wherein the first extending portion is provided to be inclined to be closer to the drum near a radial outer side of the first pulley.

10. The washing machine of claim 3, wherein a second rotational path of the second belt is configured to be inside a first rotational path of the first belt when viewed from behind the drum.

11. The washing machine of claim 10, further comprising:

an idler connected to the first belt, wherein the first driving motor, the first pulley, and the idler are connected to the first belt, forming the first rotational path.

12. The washing machine of claim 10, wherein the first pulley comprises:

a first base portion extending at a rear of the second driving motor in a radial direction of the first pulley; and a first coupling portion extending from the first base portion toward the drum to cover the second driving motor and to which the first belt is coupled.

13. The washing machine of claim 1, wherein the first driving motor is configured to selectively rotate the pulsator in one of a same direction as a rotating direction of the drum and an opposite direction of the rotating direction of the drum.

14. The washing machine of claim 3, wherein the first shaft is rotatably inserted into the second shaft.

15. The washing machine of claim 3, wherein the first pulley is disposed to be spaced more from the drum than the second pulley is.

16. A washing machine, comprising:

a main body having a laundry inlet on a front portion;

a tub provided inside the main body to store water;

a drum rotatably installed inside the tub;

reinforcing ribs formed in a bottom portion of the tub to prevent warping when the tub is injected;

a pulsator provided inside the drum and configured to be rotatable with respect to the drum;

a first pulley connected to the pulsator;

a second pulley connected to the drum, wherein a diameter of the first pulley is the same as a diameter of the second pulley;

a first driving motor to provide power to the pulsator; and a second driving motor to provide power to the drum.

17. The washing machine of claim 16, further comprising:

a first shaft extending from the pulsator along a rotation axis of the pulsator, wherein the first shaft connects the pulsator to the first pulley; and a first belt connecting the first driving motor and the first pulley.

18. The washing machine of claim 17, further comprising:

a second shaft extending from the drum along a rotation axis of the drum, wherein the second shaft connects the pulsator to the second pulley; and a second belt connecting the second driving motor and the second pulley.

19. The washing machine of claim 18, wherein the first pulley is different in size from the second pulley.

20. The washing machine of claim 18, wherein driving force of the first driving motor is different from driving force of the second driving motor.

* * * * *